US011658379B2

(12) United States Patent
Wrigley et al.

(10) Patent No.: US 11,658,379 B2
(45) Date of Patent: May 23, 2023

(54) WAVEGUIDE HYBRID COUPLERS

(71) Applicant: LOCKHEED MARTIN CORPORATION, Bethesda, MD (US)

(72) Inventors: Jason Stewart Wrigley, Littleton, CO (US); Mark Winebrand, Littleton, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 329 days.

(21) Appl. No.: 17/037,260

(22) Filed: Sep. 29, 2020

(65) Prior Publication Data

US 2021/0119315 A1 Apr. 22, 2021

Related U.S. Application Data

(60) Provisional application No. 62/923,387, filed on Oct. 18, 2019.

(51) Int. Cl.

| | |
|---|---|
| ***H01P 5/18*** | (2006.01) |
| ***H01P 1/161*** | (2006.01) |
| ***H01Q 25/00*** | (2006.01) |
| ***H01Q 21/00*** | (2006.01) |
| ***H01Q 19/10*** | (2006.01) |
| *H01Q 15/16* | (2006.01) |

(52) U.S. Cl.

CPC ..... *H01P 5/182* (2013.01); *H01P 1/161* (2013.01); *H01Q 19/10* (2013.01); *H01Q 21/0037* (2013.01); *H01Q 25/001* (2013.01); *H01Q 15/16* (2013.01)

(58) Field of Classification Search

CPC ..... H01P 5/12; H01P 5/18; H01P 5/182

See application file for complete search history.

(56) References Cited

U.S. PATENT DOCUMENTS

| | | | | |
|---|---|---|---|---|
| 3,077,565 | A * | 2/1963 | Riblet | H01P 5/182 327/39 |
| 3,958,193 | A * | 5/1976 | Rootsey | H01P 5/12 333/125 |
| 4,688,006 | A * | 8/1987 | Wong | H01P 5/182 333/248 |
| 6,577,207 | B2 * | 6/2003 | Volman | H01P 1/172 333/125 |
| 9,147,921 | B2 * | 9/2015 | Delgado | H01P 1/165 |
| 9,331,371 | B2 * | 5/2016 | Shijo | H01P 5/19 |
| 9,343,795 | B1 * | 5/2016 | Halligan | H01P 5/16 |
| 11,569,554 | B2 * | 1/2023 | Menargues Gomez | H01P 1/161 |

* cited by examiner

*Primary Examiner* — Hafizur Rahman
*Assistant Examiner* — Alan Wong
(74) *Attorney, Agent, or Firm* — BakerHostetler

(57) ABSTRACT

A TE20 launch guidance waveguide hybrid coupler includes a waveguide body, a cavity, a plurality of ports, and a bend along the H-plane. The waveguide body includes a hybrid center portion which is disposed between and is in direct communication with the plurality of ports. The bend along the H-Plane is defined within the hybrid center portion, assists in the launching of the TE20 mode, and results in typically half the axial ratio and mass when compared to traditional hybrid approaches.

16 Claims, 7 Drawing Sheets

WAVEGUIDE HYBRID COUPLERS

CROSS-REFERENCES TO RELATED APPLICATIONS

This application claims priority to U.S. Provisional Patent Application No. 62/923,387 filed Oct. 18, 2019, and the entire contents of this document being incorporated herein by this reference.

STATEMENT REGARDING FEDERALLY SPONSORED RESEARCH OR DEVELOPMENT

Not applicable.

BACKGROUND

Field

The present description relates in general to waveguide hybrids, and more particularly to, for example, without limitation, TE20 launch-guidance hybrids.

Description of the Related Art

The description provided in the background section should not be assumed to be prior art merely because it is mentioned in or associated with the background section. The background section may include information that describes one or more aspects of the subject technology.

Satellite feed networks may be generally equipped with orthomode transducers (OMTs) or junctions such as quadrature junctions (QJs). OMTs or QJs can be mated with 3 dB waveguide hybrids to generate dual circular polarization. In some applications, waveguide hybrids equally split the power from the OMT and shift the phase of the split signal by 90 degrees.

Conventional waveguide hybrids may be bandlimited because the power split difference increases as bandwidth increases. Further, the axial ratio of conventional waveguide hybrids is mostly driven by the power split difference rather than the phase shift difference from 90 degrees.

It would be advantageous to reduce the axial ratio and the mass of the waveguide hybrid. Further, in some applications, it is desirable to improve return loss and achievable bandwidth for spot type bands such as global positioning system (GPS).

SUMMARY

The subject technology is illustrated, for example, according to various aspects described below.

According to some embodiments a waveguide hybrid coupler can include a waveguide body having a hybrid center portion and defining an H-Plane; a cavity defined within the waveguide body; a plurality of ports defined within the waveguide body, wherein the hybrid center portion is disposed between the plurality of ports and each of the ports of the plurality of ports are in communication with the cavity; and a bend along the H-Plane defined within the hybrid center portion, wherein the bend is configured to assist in the generation of the TE20 mode.

Optionally, the waveguide hybrid coupler includes septum defined within the waveguide body, wherein the septum is recessed from the hybrid center portion. The septum can include a chamfered edge.

In some applications, the bend includes a plurality of transformer steps extending away from the hybrid center portion.

Optionally, the plurality of ports includes an input port, a first output port, and a second output port. The power from the input port can be equally split between the first output port and the second output port. Further, a signal of the second output port can be phase shifted by 90 degrees relative to a signal of the first output port.

According to some embodiments, a waveguide hybrid coupler can include a waveguide body having a hybrid center portion; a cavity defined within the waveguide body; a plurality of ports defined within the waveguide body, wherein the hybrid center portion is disposed between the plurality of ports and each of the ports of the plurality of ports are in communication with the cavity; and a septum defined within the waveguide body, wherein the septum is recessed from the hybrid center portion and the septum is configured to generate a TE20 mode.

Optionally, the waveguide body defines an H-plane and the waveguide hybrid coupler further includes a bend along the H-Plane defined within the hybrid center portion. The bend can include a plurality of transformer steps extending away from the hybrid center portion.

In some applications, the septum includes a chamfered edge.

Optionally, the plurality of ports includes an input port, a first output port, and a second output port. The power from the input port can be equally split between the first output port and the second output port. Further, a signal of the second output port can be phase shifted by 90 degrees relative to a signal of the first output port.

According to some embodiments, a method to split power from a source can include receiving an input signal within a waveguide hybrid coupler, wherein the waveguide hybrid coupler includes an H-plane bend; beginning the launch of the TE20 mode at the H-plane bend from the input signal; and directing the input signal equally between a first output port and a second output port of the waveguide hybrid coupler.

Optionally, the method can include directing the TE20 mode toward a hybrid center of the waveguide hybrid coupler via a septum or a transformer step.

In some applications, the method can include equally splitting a Ka band, such as a low GPS band, or a high GPS band between the first output port and the second output port of the waveguide hybrid coupler.

In the following description, specific embodiments are described to shown by way of illustration how the invention may be practiced. It is to be understood that other embodiments may be utilized and changes may be made without departing from the scope of the present invention.

DETAILED DESCRIPTION

Figure 1:
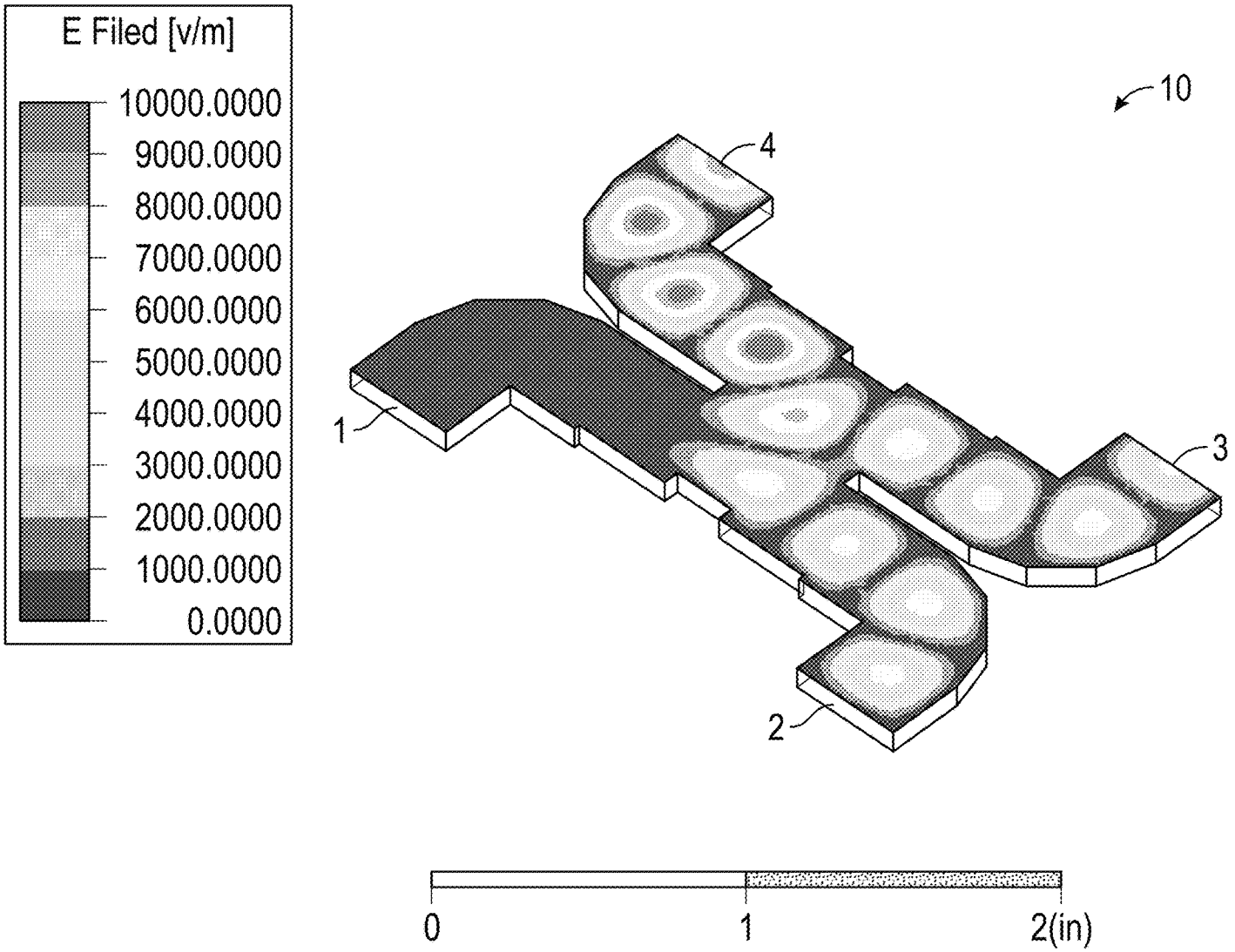
FIG. 1 is a cross-sectional view of a prior art waveguide hybrid with the E-Field distribution plotted.

FIG. 1 illustrates a cross-sectional view of a prior art waveguide hybrid coupler 10 with the E-Field distribution plotted. As described herein, the waveguide hybrid coupler 10 can equally split the power to a source or combine the power from a source, such as an OMT or QJ, and shift the phase of the split or combined signal by 90 degrees.

In the depicted example, the waveguide hybrid coupler 10 includes a body that defines a cavity therein. As described herein, the geometry of the body and cavity can determine the characteristics and behavior of the waveguide hybrid coupler 10. The waveguide hybrid coupler 10 includes one or more ports, such as ports 1, 2, 3, 4 in communication with the body and/or the cavity of the waveguide hybrid coupler 10 to receive input signals and provide output signals.

During operation, the waveguide hybrid coupler 10 can receive an input signal from a source at an input port, such as port 1. The input can be received as a TE10 mode within the waveguide hybrid coupler 10.

The geometry of the body and/or cavity of the waveguide hybrid coupler 10 can generate a TE20 mode in the center portion of the waveguide hybrid coupler 10. The waveguide hybrid coupler 10 can provide two equally split TE10 modes coupling to the output ports, such as ports 2, 3.

For example, if port 1 is driven with a signal of 1 watt, the waveguide hybrid coupler 10 can provide an output signal of 0.5 watts from port 2 and port 3, with port 4 being isolated. The waveguide hybrid coupler 10 can generate right handed circular polarization (RHCP) by driving port 1 with the input signal and providing an output at the ports 2, 3 with a 90 degree phase shift. Further, the waveguide hybrid coupler 10 can generate left handed circular polarization (LHCP) by driving port 4 with the input signal and providing an output at the ports 2, 3 with a 90 degree phase shift.

As can be appreciated by the present disclosure, the characteristics of the waveguide hybrid coupler 10, such as the geometry of body or cavity of the waveguide hybrid coupler 10, including the center portion of the waveguide, can determine the properties of the generated TE20 mode. In turn, the generated TE20 mode determines the power split and the axial ratio provided by the waveguide hybrid coupler 10. In some applications, conventional waveguide hybrids, such as the waveguide hybrid coupler 10, can have a relatively large size and mass to provide the generated TE20 mode.

Figure 2:
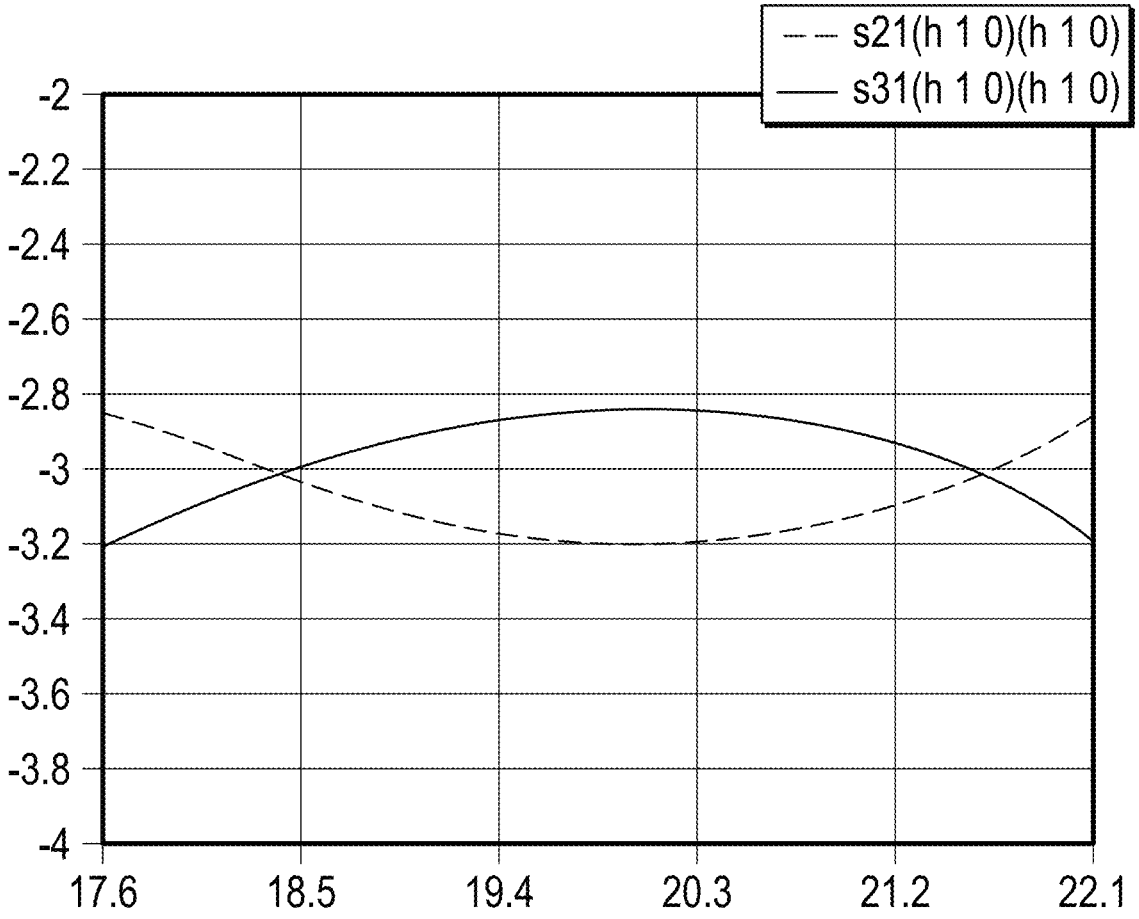
FIG. 2 is a chart illustrating a power split of the prior art waveguide hybrid coupler of FIG. 1.

FIG. 2 is a chart illustrating a power split of the prior art waveguide hybrid coupler 10 of FIG. 1. In some applications, conventional waveguide hybrids, such as the waveguide hybrid coupler 10, may be bandlimited as the power split difference increases as bandwidth increases, as shown by the power split of a typical Ka Band in FIG. 2. Further, the axial ratio of conventional waveguide hybrids, such as the waveguide hybrid coupler 10 is mostly driven by the power split difference rather than the phase shift difference from 90 degrees. Accordingly, conventional waveguide hybrids, such as the waveguide hybrid coupler 10, with high axial ratios can limit the achievable bandwidth for certain bands, such as Ka Band.

Therefore, it is desirable to reduce the size, the mass, and the axial ratio of the waveguide hybrid coupler 10. Further, in some applications, it is desirable to improve return loss and achievable bandwidth for spot type bands such as GPS.

As appreciated by the present disclosure, embodiments of the waveguide hybrid coupler disclosed herein can include features to improve the generation of the TE20 mode and therefore improve the power split and the axial ratio provided by the waveguide hybrid coupler.

Various aspects of the present disclosure further provide a significant improvement in return loss and port to port for continuous 23% bandwidth. Further, various aspects of the present disclosure provide improved axial ratios for GPS "spot" bands over a 32% bandwidth. Various aspects of the present disclosure provide a waveguide hybrid coupler that is more compact than conventional waveguide hybrids. Additionally, embodiments of the waveguide hybrid coupler can be more easily manufactured than conventional waveguide hybrid couplers.

The present description relates in general to waveguide hybrids, and more particularly to, for example, without limitation, TE20 launch-guidance hybrids. For the purposes of the present description, the waveguides will be described with respect to transmitters for space applications, e.g. satellite feed networks. However, the various embodiments of waveguides are not limited to the aforementioned configuration, but to any conceivable application of waveguides.

Figure 3:
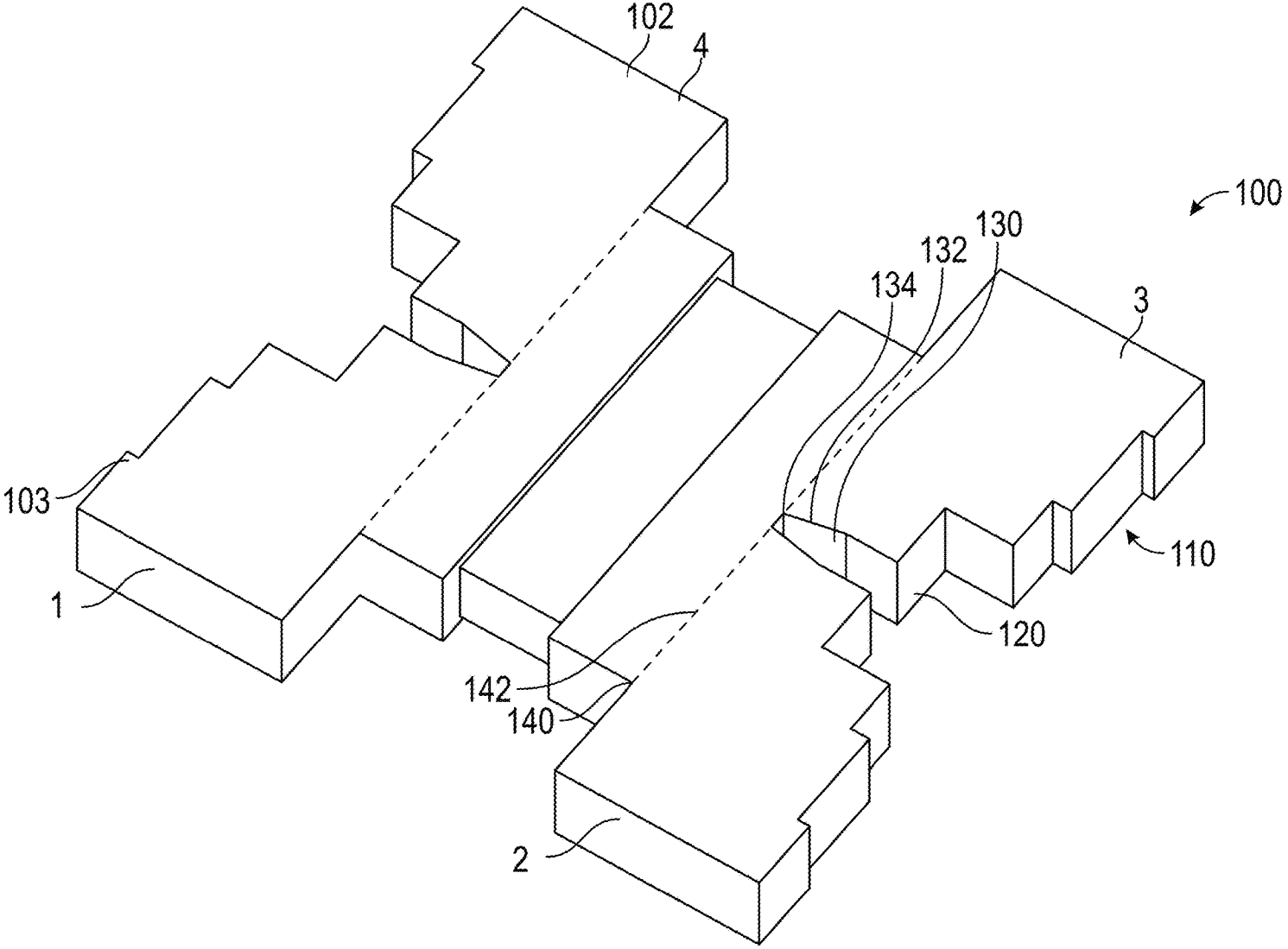
FIG. 3 illustrates a perspective view of a waveguide hybrid coupler, according to some embodiments of the present disclosure.
Figure 4:
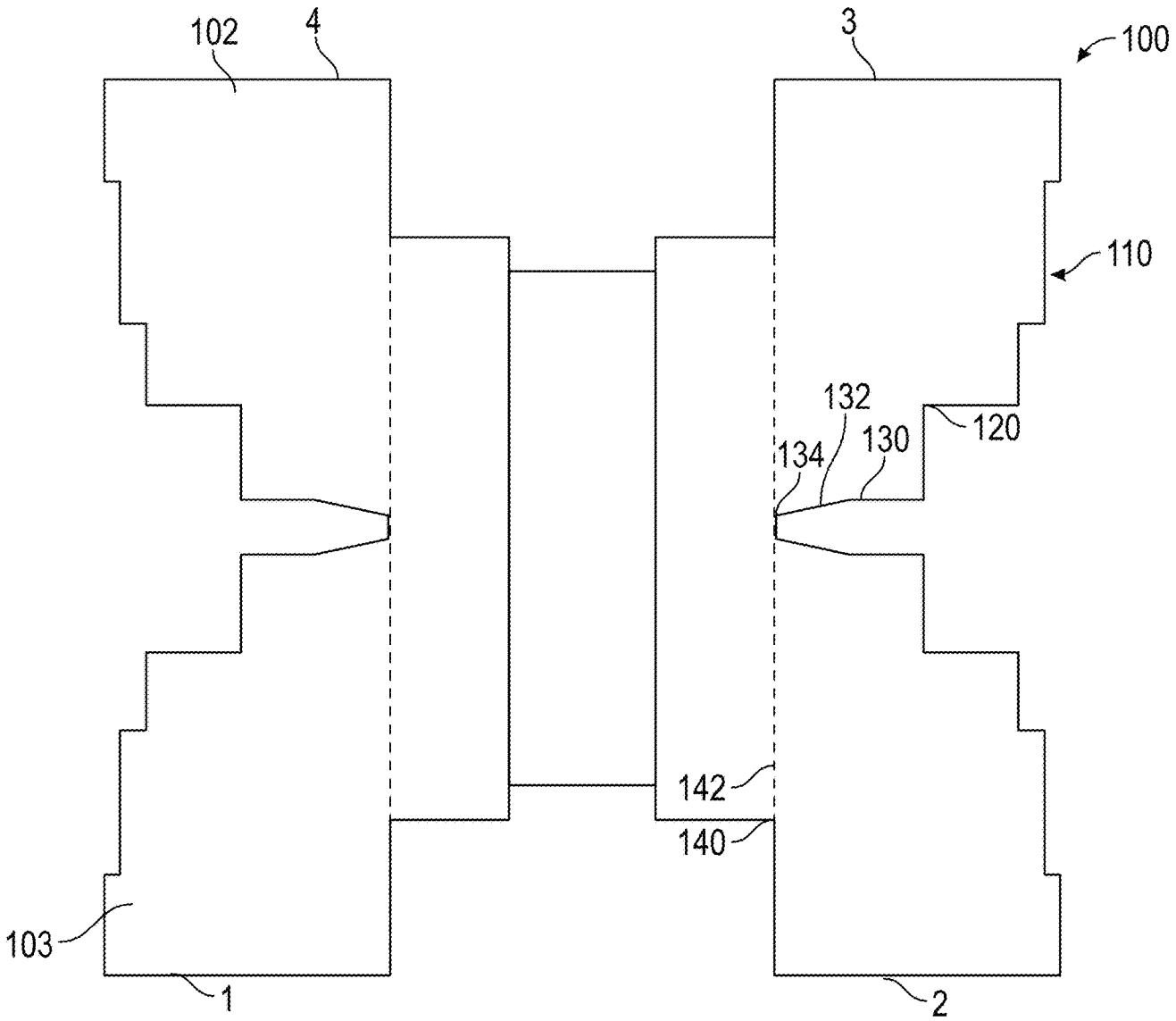
FIG. 4 is an elevation view of the waveguide hybrid coupler of FIG. 3.

FIG. 3 illustrates a perspective view of a waveguide hybrid coupler 100, according to some embodiments of the present disclosure. FIG. 4 is an elevation view of the waveguide hybrid coupler 100 of FIG. 3. With reference to FIGS. 3 and 4, the waveguide hybrid coupler 100 is a coupler that can equally split power from a source, such as an OMT or QJ, and shift the phase of the split signal by 90 degrees. As described herein, the waveguide hybrid coupler 100 can include features to improve the generation of the TE20 mode and the performance of the waveguide hybrid coupler 100, and therefore reduce the size, mass, and the axial ratio of the waveguide hybrid coupler 100 relative to conventional waveguides, such as the waveguide hybrid coupler 10.

In the depicted example, the waveguide hybrid coupler 100 includes a body 102 that defines a cavity 103 therein. The body 102 can include a hybrid center portion 140. As described herein, the body 102, the cavity 103, and/or the hybrid center portion 140 can include features or shapes that determine or affect the characteristics and behavior of the waveguide hybrid coupler 100.

As illustrated, the waveguide hybrid coupler 100 includes one or more ports, such as ports 1, 2, 3, 4, in communication or otherwise connected by the cavity 103 and/or the body 102 of the waveguide hybrid coupler 100. As illustrated, the ports 1, 2, 3, 4 can be disposed around the hybrid center portion 140, such that the hybrid center portion 140 is surrounded by or disposed between the ports 1, 2, 3, 4.

In the depicted example, during operation, the waveguide hybrid coupler 100 can receive an input signal from a source at an input port, such as port 1. The input can be received as a TE10 mode.

As described herein, features of the hybrid center portion 140 and the body 102 generally can launch a TE20 mode in the hybrid center portion 140 of the waveguide hybrid coupler 100. The waveguide hybrid coupler 100 can provide two equally split TE10 modes coupling to the output ports, such as ports 2, 3.

As can be appreciated, the ports 1, 2, 3, 4, can be configured to function as input ports or output ports. For example, one port can be configured to be an input port to receive an input signal from an input source, such as an OMT or QJ, and two ports can be configured to be output ports that equally split the input signal. One of the ports can be isolated. As can be appreciated, by altering the ports 1, 2, 3, 4 that are driven and isolated, the polarization or phase shift of the output ports can be adjusted.

For example, if port 1 is driven with a signal of 1 watt, the waveguide hybrid coupler 100 can provide an output signal of 0.5 watts from port 2 and port 3, with port 4 being isolated. The waveguide hybrid coupler 100 can generate right handed circular polarization (RHCP) by driving port 1 with the input signal and providing an output at the ports 2, 3 with a 90 degree phase shift. Further, the waveguide hybrid coupler 100 can generate left handed circular polarization (LHCP) by driving port 4 with the input signal and providing an output at the ports 2, 3 with a 90 degree phase shift.

In the depicted example, the waveguide hybrid coupler 100 includes features to facilitate or generate the TE20 mode to allow for a low axial ratio and provide a power split of a wide range of desired bandwidth. Further, the features described herein allow the waveguide hybrid coupler 100 to be smaller and lighter than conventional waveguide hybrids. In some embodiments, the waveguide hybrid coupler 100 can include features in the plane defined by the body 102 containing the magnetic field vector and the direction of maximum radiation, referred to as the H-Plane, to generate the TE20 mode. For a vertically polarized antenna, the H-Plane usually coincides with the horizontal/azimuth plane and for a horizontally polarized antenna, the H-Plane coincides with the vertical/elevation plane.

In some embodiments, the waveguide hybrid coupler 100 includes a bend 120 in the H-Plane configured to begin generation of the TE20 mode. As illustrated, the bend 120 is disposed within the hybrid center portion 140 of the waveguide hybrid coupler 100, improving the TE20 mode generation and reducing the axial ratio relative to a conventional waveguide. In some embodiments, the bend 120 can reduce the axial ratio by up to one half of the axial ratio of a conventional waveguide hybrid.

As illustrated, the bend 120 include a discontinuity, corner, step, or surface within the H-Plane that acts as a launching step for the TE20 mode. The bend 120 can include an approximately 90 degree angle to form the corner or step. The bend 120 can be located within the H-Plane as close as possible to the natural TE20 launch hybrid center, reducing the axial ratio.

Optionally, the waveguide hybrid coupler 100 can include one or more transformer steps 110 to adapt the waveguide hybrid coupler 100 to a standard waveguide size, allowing the waveguide hybrid coupler 100 to be used with components configured for use with conventional waveguides. As illustrated, the transformer steps 110 can extend from the bend 120 toward one or more of the ports 1, 2, 3, 4. The transformer steps 110 can extend or expand generally outward in a stepped or angular manner from the hybrid center portion 140 toward the ports 1, 2, 3, 4.

As illustrated, the transformer steps 110 include a discontinuity, corner, step, or surface. The transformer steps 110 can include an approximately 90 degree angle to form one or more corner or step. In some embodiments, the transformer steps 110 are incorporated into the bend 120 within the H-Plane. Advantageously, in contrast to a smooth chamfered miter transition, the bends and surfaces of the transformer steps 110 can further reinforce or more strongly launch and steer the TE20 mode into the hybrid center portion 140.

In the depicted example, the waveguide hybrid coupler 100 can define a septum 130 to further steer the TE20 mode launched by the bend 120 into the hybrid center portion 140. The septum 130 is formed to extend into the body 102. Further, the septum 130 can be recessed such that the bend 120 is inside the hybrid center portion 140 of the waveguide hybrid coupler 100.

As illustrated, a septum tip 134 is recessed or spaced apart from a plane 142 defined by the hybrid center portion 140 of the waveguide hybrid coupler 100. As a result, the bend 120 can be located in the H-Plane such that the corner of the bend 120 is disposed beyond the septum tip 134 of a septum 130.

Optionally, the septum tip 134 can include chamfering 132 to further steer the TE20 mode launched by the bend 120. Further, chamfering 132 of the septum 130 can improve manufacturing processes for the waveguide hybrid coupler 100.

Figure 5:
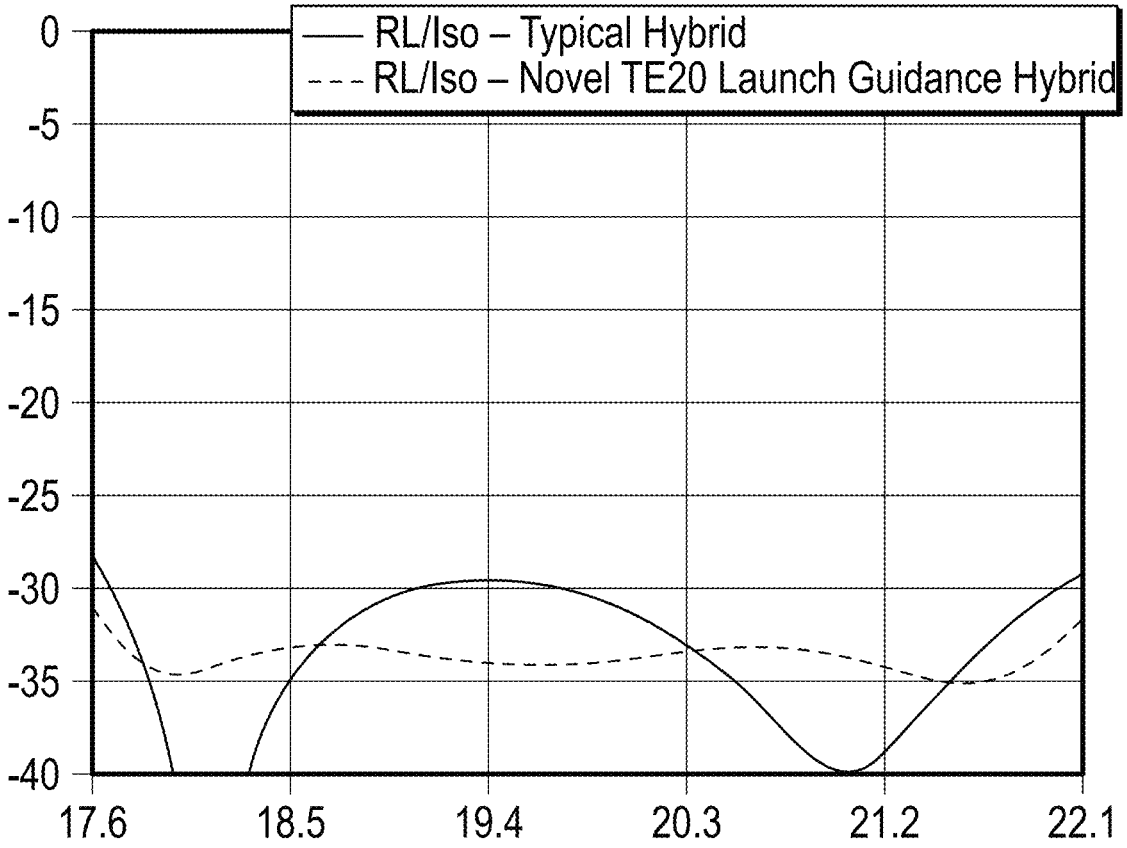
FIG. 5 is a chart illustrating return loss and isolation values for the waveguide hybrid coupler of FIG. 3 compared to the prior art waveguide hybrid coupler of FIG. 1.
Figure 6:
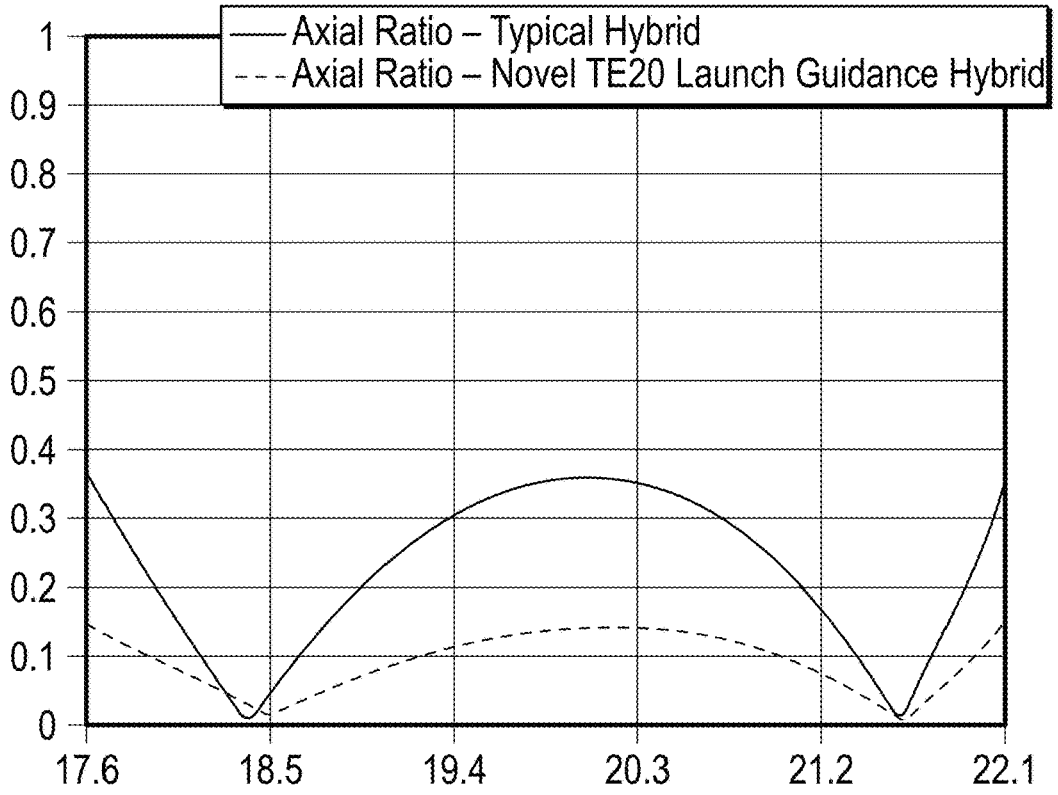
FIG. 6 is a chart illustrating axial ratio values for the waveguide hybrid coupler of FIG. 3 compared to the prior art waveguide hybrid coupler of FIG. 1.

FIG. 5 is a chart illustrating return loss and isolation values for the waveguide hybrid coupler 100 of FIG. 3 compared to the prior art waveguide hybrid coupler 10 of FIG. 1. FIG. 6 is a chart illustrating axial ratio values for the waveguide hybrid coupler 100 of FIG. 3 compared to the prior art waveguide hybrid coupler 10 of FIG. 1. Advantageously, features of the waveguide hybrid coupler 100 that allow for TE20 launch guidance provide a significant improvement in return loss, port to port, and axial ratio for continuous 23% bandwidth, as illustrated in FIGS. 5 and 6. As shown in FIG. 6, the waveguide hybrid coupler 100 provides at least a two times better axial ratio compared to conventional waveguides.

Figure 7:
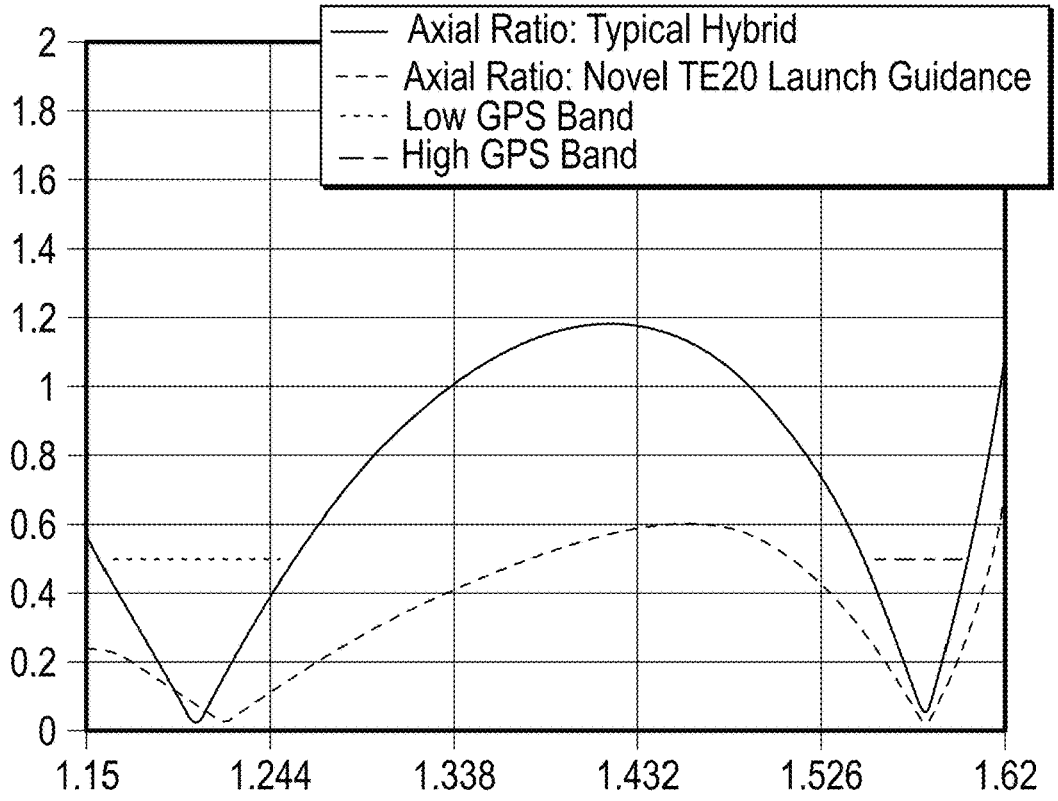
FIG. 7 is a chart illustrating axial ratio values for the waveguide hybrid coupler of FIG. 3 compared to the prior art waveguide hybrid coupler of FIG. 1 with the low GPS band and the high GPS band identified.
Figure 8:
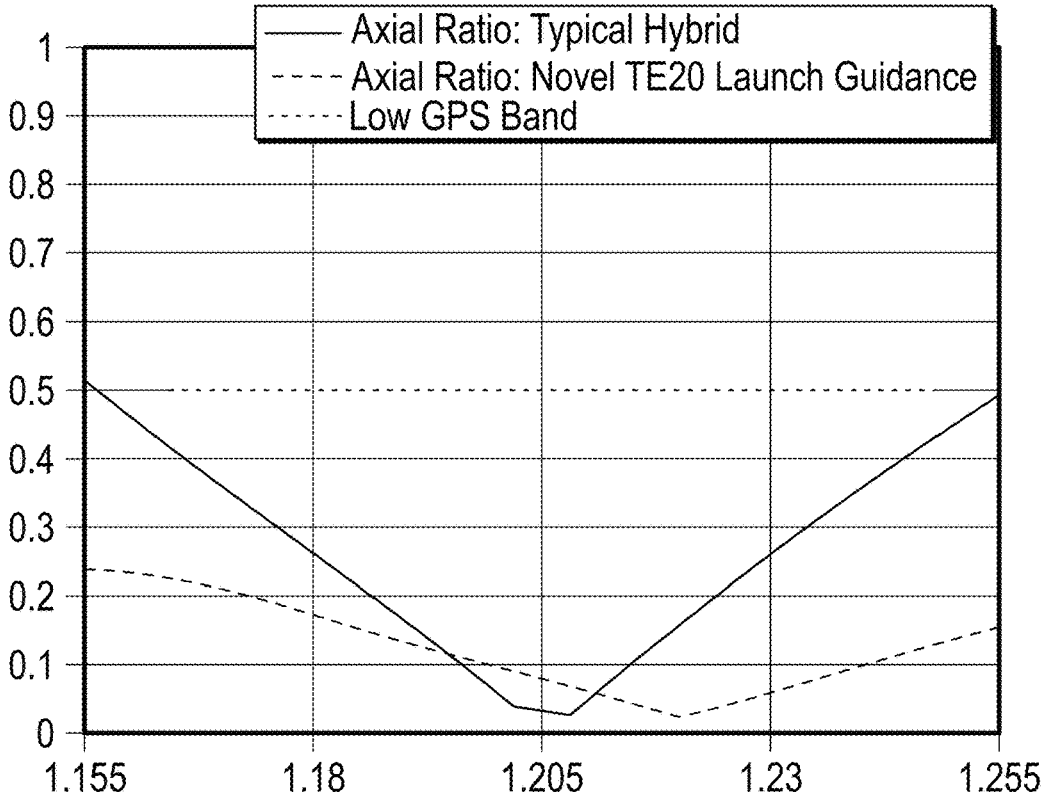
FIG. 8 is a detail view of the chart of FIG. 7 illustrating axial ratio values for the waveguide hybrid coupler of FIG. 3 compared to the prior art waveguide hybrid coupler of FIG. 1 with respect to the low GPS band.
Figure 9:
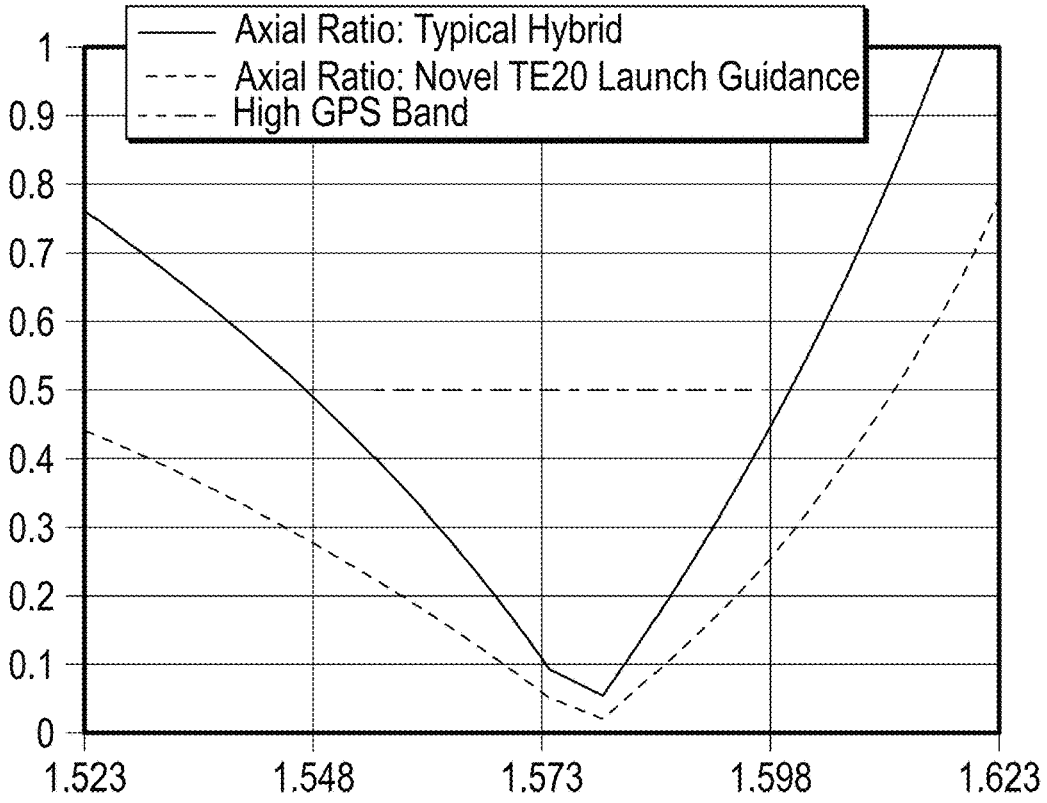
FIG. 9 is a detail view of the chart of FIG. 7 illustrating axial ratio values for the waveguide hybrid coupler of FIG. 3 compared to the prior art waveguide hybrid coupler of FIG. 1 with respect to the high GPS band.

FIG. 7 is a chart illustrating axial ratio values for the waveguide hybrid coupler 100 of FIG. 3 compared to the prior art waveguide hybrid coupler 10 of FIG. 1 with the low GPS band and the high GPS band identified. FIG. 8 is a detail view of the chart of FIG. 7 illustrating axial ratio values for the waveguide hybrid coupler 100 of FIG. 3 compared to the prior art waveguide hybrid coupler 10 of FIG. 1 with respect to the low GPS band. FIG. 9 is a detail view of the chart of FIG. 7 illustrating axial ratio values for the waveguide hybrid coupler 100 of FIG. 3 compared to the prior art waveguide hybrid coupler 10 of FIG. 1 with respect to the high GPS band. With reference to FIGS. 7-9, features of the waveguide hybrid coupler 100 allow for improved (or reduced) axial ratios for desired bands, such as particular GPS "spot" bands over a 32% bandwidth. As illustrated, the waveguide hybrid coupler 100 provides a more than 2 times better axial ratio for the identified low GPS bands and high GPS bands compared to conventional waveguides.

Terms such as "top," "bottom," "front," "rear", "above", and "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A waveguide hybrid coupler, comprising:

a waveguide body having a hybrid center portion and defining an H-Plane;

a cavity defined within the waveguide body;

a plurality of ports defined within the waveguide body, wherein the hybrid center portion is disposed between the plurality of ports and each of the ports of the plurality of ports are in communication with the cavity;

a bend along the H-Plane defined within the hybrid center portion, wherein the bend is configured to generate a TE20 mode; and a septum defined within the waveguide body, wherein the septum is recessed from the hybrid center portion, wherein the septum comprises a chamfered edge.

2. The waveguide hybrid coupler of claim 1, wherein the bend includes a plurality of transformer steps extending away from the hybrid center portion.

3. The waveguide hybrid coupler of claim 1, wherein the plurality of ports comprises an input port, a first output port, and a second output port.

4. The waveguide hybrid coupler of claim 3, wherein power from the input port is equally split between the first output port and the second output port.

5. The waveguide hybrid coupler of claim 3, wherein a signal of the second output port is phase shifted by 90 degrees relative to a signal of the first output port.

6. A waveguide hybrid coupler, comprising:

a waveguide body having a hybrid center portion;

a cavity defined within the waveguide body;

a plurality of ports defined within the waveguide body, wherein the hybrid center portion is disposed between the plurality of ports and each of the ports of the plurality of ports are in communication with the cavity; and a septum defined within the waveguide body, wherein the septum comprises a chamfered edge and is recessed from the hybrid center portion and the septum is configured to generate a TE20 mode.

7. The waveguide hybrid coupler of claim 6, wherein the waveguide body defines an H-plane and the waveguide hybrid coupler further comprising a bend along the H-Plane defined within the hybrid center portion.

8. The waveguide hybrid coupler of claim 7, wherein the bend includes a plurality of transformer steps extending away from the hybrid center portion.

9. The waveguide hybrid coupler of claim 6, wherein the plurality of ports comprises an input port, a first output port, and a second output port.

10. The waveguide hybrid coupler of claim 9, wherein power from the input port is equally split between the first output port and the second output port.

11. The waveguide hybrid coupler of claim 9, wherein a signal of the second output port is phase shifted by 90 degrees relative to a signal of the first output port.

12. A method to split power from a source, the method comprising:

receiving an input signal within a waveguide hybrid coupler, wherein the waveguide hybrid coupler comprises an H-plane bend;

launching a TE20 mode at the H-plane bend from the input signal;

directing the input signal equally between a first output port and a second output port of the waveguide hybrid coupler; and directing the TE20 mode toward a hybrid center of the waveguide hybrid coupler via a septum, the septum comprising a chamfered edge.

13. The method of claim 12, further comprising directing the TE20 mode toward the hybrid center of the waveguide hybrid coupler via a transformer step.

14. The method of claim 12, further comprising equally splitting a Ka band between the first output port and the second output port of the waveguide hybrid coupler.

15. The method of claim 12, further comprising equally splitting a low GPS band between the first output port and the second output port of the waveguide hybrid coupler.

16. The method of claim 12, further comprising equally splitting a high GPS band between the first output port and the second output port of the waveguide hybrid coupler.

* * * * *